US005882483A

United States Patent [19]

Mulligan

[11] Patent Number: 5,882,483

[45] Date of Patent: Mar. 16, 1999

[54] EXTENDED NIP PRESS APPARATUS

[75] Inventor: Patrick Mulligan, Dubuque, Iowa

[73] Assignee: Beloit Technologies, Inc., Wilmington, Del.

[21] Appl. No.: 95,224

[22] Filed: Jun. 10, 1998

[51] Int. Cl.[6] ..... D21F 3/08

[52] U.S. Cl. ..... 162/358.3; 162/361; 492/7; 492/20

[58] Field of Search ..... 162/358.3, 361; 492/7, 16

[56] References Cited

U.S. PATENT DOCUMENTS

| | | | |
|---|---|---|---|
| 4,113,325 | 9/1978 | Miller | 308/9 |
| 4,673,461 | 6/1987 | Roeriyl et al. | 162/361 |
| 5,223,100 | 6/1993 | Schiel et al. | 162/358.3 |
| 5,662,777 | 9/1997 | Schiel et al. | 162/358.3 |

*Primary Examiner*—Karen M. Hastings

*Attorney, Agent, or Firm*—Lathrop & Clark LLP

[57] ABSTRACT

An extended nip press apparatus is disclosed for pressing a web. The apparatus includes an elongate press shoe which defines a concave surface. A backing roll cooperates with the concave surface for defining therebetween an extended nip pressing section for pressing the web. A looped bearing blanket slidably cooperates with the concave surface. The blanket is disposed between the shoe and the backing roll for supporting and guiding the web through the pressing section. A piston is pivotally connected to the press shoe, the piston being selectively urged towards the backing roll. The arrangement is such that when the piston is urged towards the backing roll, the piston urges the shoe and the blanket towards the backing roll so that the web disposed between the blanket and the backing roll is pressed. The piston has a first and a second portion, the first portion being disposed between the second portion and the shoe. At least one resilient pad is disposed between the portions for absorbing shock loads exerted on the blanket during operation of the apparatus so that wear of the blanket is reduced.

11 Claims, 2 Drawing Sheets

EXTENDED NIP PRESS APPARATUS

BACKGROUND OF THE INVENTION

FIELD OF THE INVENTION

The present invention relates to an extended nip press apparatus for pressing a web.

More specifically, the present invention relates to an extended nip press having a press shoe, a backing roll and a looped bearing blanket.

INFORMATION DISCLOSURE STATEMENT

In the production of a pressed web, a formed web is transferred to a press section for removing a large percentage of the water from the formed web.

In the prior art, cooperating roll couples have been used to press the water from the web as the web extends through a nip defined between the cooperating rolls. However, with roll couple presses, the residence time of the web within the nip is of relatively short duration.

Accordingly, extended nip presses have been developed in which an elongate press shoe having a concave surface cooperates with a backing roll for defining therebetween an extended nip press section.

A resilient bearing blanket movably and slidably extends through the pressing section for conveying and guiding the web through the pressing section. The extended nip press apparatus has an advantage over the roll couple press in that the residence time of the web within the nip is increased so that more water is removed from the web.

However, in view of the relatively high pressures used in an extended nip press such as 600 lbs. per linear inch, there is a tendency for the bearing blanket to wear rapidly. Typically the looped bearing blankets used in an ENP include urethane coatings which are vented or grooved in order to assist removal of the water pressed from the web.

Consequently, as the vented bearing blanket continuously extends through the extended nip pressing section, there is a tendency for such bearing blanket to rapidly disintegrate.

The present invention overcomes the aforementioned problem of blanket wear by the provision of resilient means within a loading piston used for loading the shoe.

Therefore it is primary objective of the present invention is to overcome the aforementioned inadequacies of the prior art arrangements and to provide an extended nip press apparatus which makes a considerable contribution to the pressing art.

Other objects and advantages of the present invention will be readily apparent to those skilled in the art by consideration of the detailed description contained hereinafter taken in conjunction with the annexed drawings.

SUMMARY OF THE INVENTION

The present invention relates to an extended nip press apparatus for pressing a web. The apparatus includes an elongate press shoe which defines a concave surface. A backing roll cooperates with the concave surface for defining therebetween an extended nip pressing section for pressing the web. A looped bearing blanket slidably cooperates with the concave surface. The blanket is disposed between the shoe and the backing roll for supporting and guiding the web through the pressing section.

A piston is pivotally connected to the press shoe, the piston being selectively urged towards the backing roll. The arrangement is such that when the piston is urged towards the backing roll, the piston urges the shoe and the blanket towards the backing roll so that the web disposed between the blanket and the backing roll is pressed.

The piston has a first and a second portion with the first portion being disposed between the second portion and the shoe.

Resilient means are disposed between the first and second portions for absorbing shock loads exerted on the blanket during operation of the apparatus so that wear of the blanket is reduced.

In a more specific embodiment of the present invention, the press shoe is a hydrodynamic shoe.

In another embodiment of the present invention, the press shoe is a hydrostatic shoe.

The looped bearing blanket is vented and the piston is hydraulically urged towards the backing roll.

More particularly, the press apparatus includes a base which defines a cylinder. The cylinder is selectively connected to a source of hydraulic pressure and slidably receives therein the piston. The arrangement is such that when the cylinder is connected to the source of hydraulic pressure, the piston is urged towards the backing roll.

In a preferred embodiment of the present invention, the piston also includes fastening means which extend through the first and the second portions for securing the portions relative to each other.

More specifically, the fasting means includes at least one bolt and the first and second portions define respectively a first and a second aligned bore. The bores threadably cooperate with the bolt for fastening the first portion to the second portion.

In a specific embodiment of the present invention, the resilient means includes at least one rubber pad which is disposed between the portions.

The resilient means includes a first and a second rubber pad, which define respectively a first and a second hole. The holes are aligned relative to each other and a locating pin extends through the holes for locating the pads relative to each other and for aligning the pads relative to the portions.

Many modifications and variations of the present invention will be readily apparent to those skilled in the art by consideration of the detailed description contained hereinafter taken in conjunction with the annexed drawings. However, such modifications and variations fall within the spirit and scope of the present invention as defined by the appended claims.

BRIEF DESCRIPTION OF THE DRAWINGS

Similar reference characters refer to similar parts throughout the various views of the drawings.

DETAILED DESCRIPTION OF THE DRAWINGS

Figure 1:
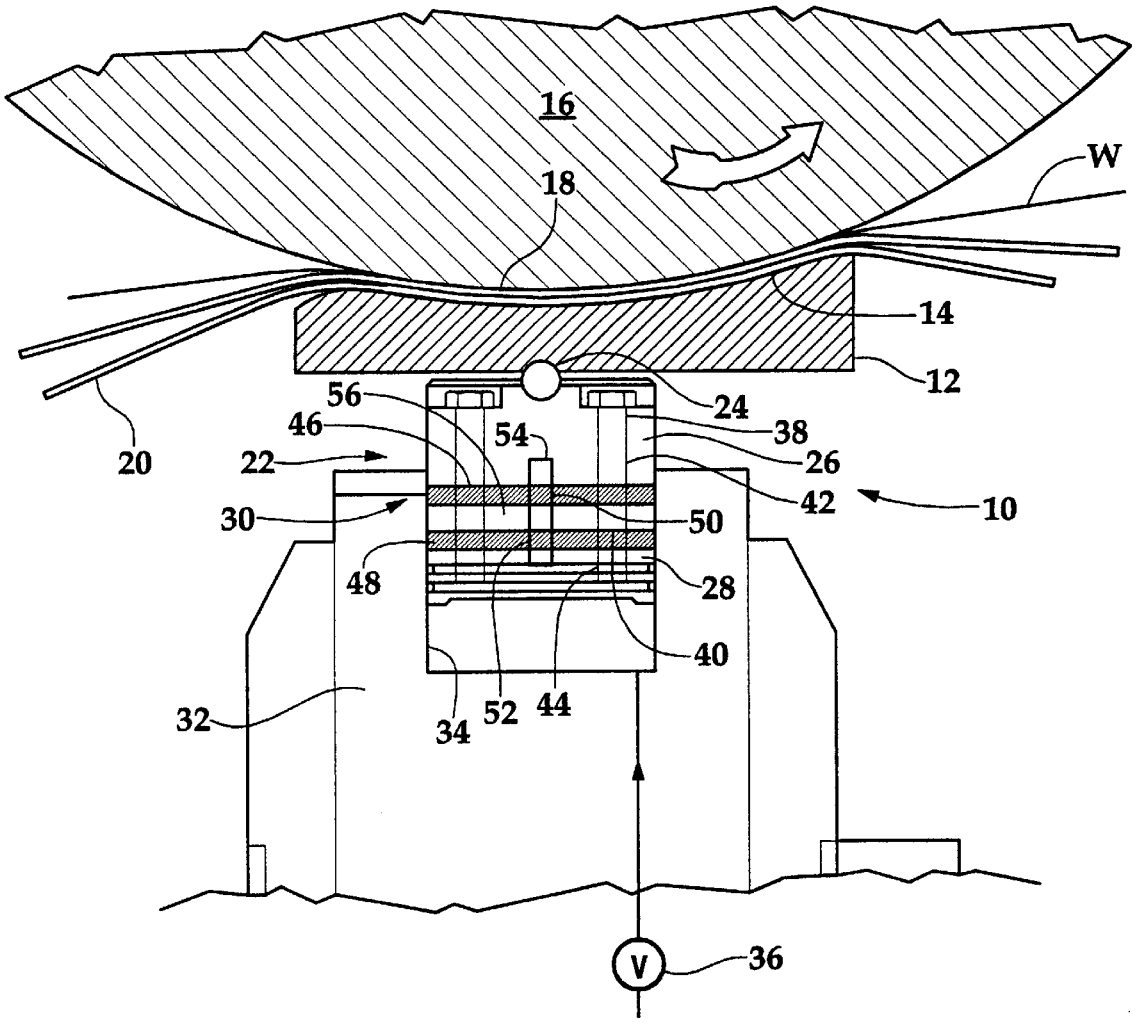
FIG. 1 is a side elevation view of one embodiment of the present invention.

FIG. 1 is a side elevational view of an extended nip press apparatus generally designated by 10 for pressing a web W. The apparatus 10 includes an elongate press shoe 12 which defines a concave surface 14.

A backing roll 16 cooperates with the concave surface 14 for defining therebetween an extended nip pressing section 18 for pressing the web W.

A looped bearing blanket 20 slidably cooperates with the concave surface 14. The blanket 20 is disposed between the shoe 12 and the backing roll 16 for supporting and guiding the web W through the pressing section 18.

A piston generally designated 22 is pivotally connected by a pivot 24 to the press shoe 1 2. The piston 22 is selectively urged towards the backing roll 16 so that when the piston 22 is urged towards said backing roll 16, the piston 22 urges the shoe 12 and the blanket 20 towards the backing roll 16 so that the web W which is disposed between the blanket 20 and the backing roll 16 is pressed.

The piston 22 has a first and a second portion 26 and 28 respectively. The first portion 26 is disposed between the second portion 28 and the shoe 12.

Resilient means generally designated 30 are disposed between the portions 26 and 28 for absorbing shock loads exerted on the blanket 20 during operation of the apparatus 10 so that wear of the blanket 20 is reduced.

As shown in FIG. 1, the press shoe 12 is a hydrodynamic shoe.

Figure 2:
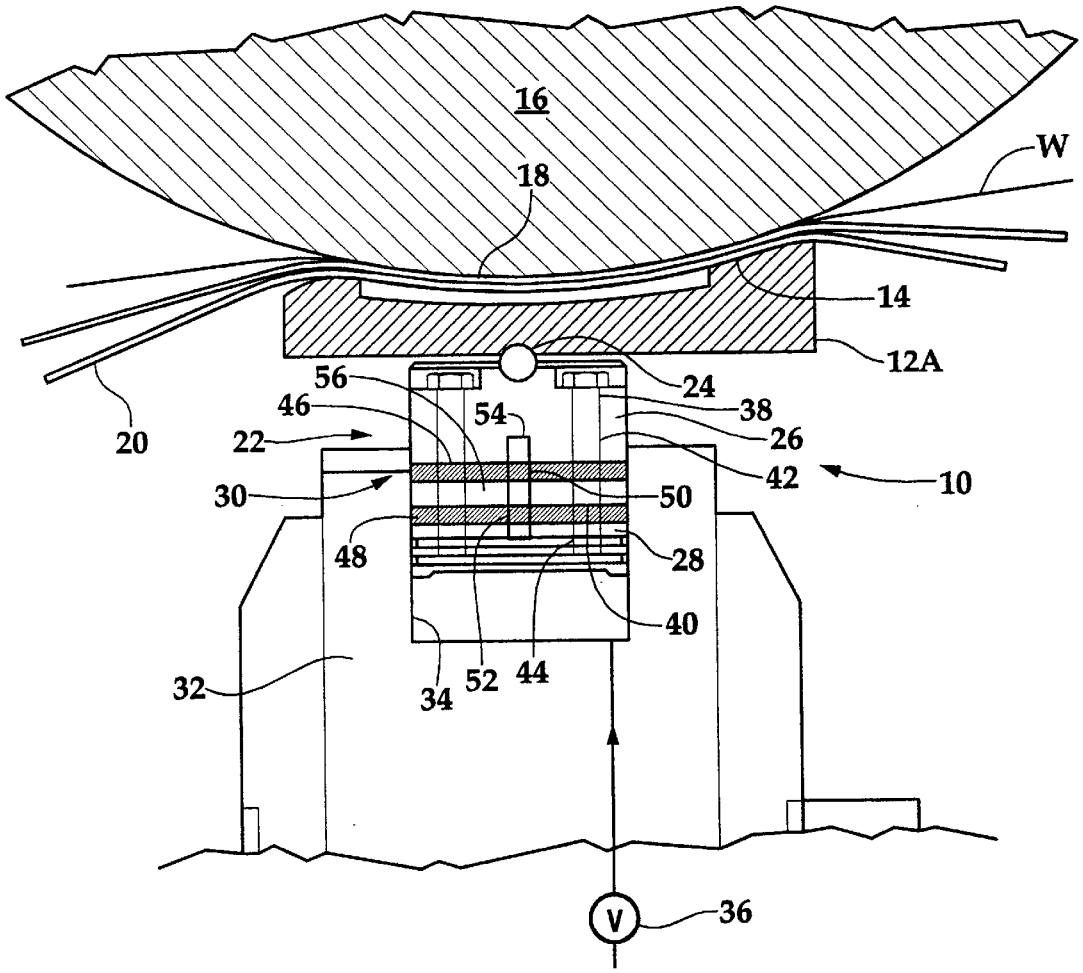
FIG. 2 is a view similar to that shown in FIG. 1 but shows an alternative embodiment to the present invention.

FIG. 2 is a similar view to that shown in FIG. 1 but shows an alternative embodiment of the present invention in which a press shoe 1 2A is a hydrostatic shoe.

As shown in both embodiments of FIGS. 1 and 2, the press apparatus includes a bearing blanket 20 which is vented.

The piston 22 as shown in FIG. 1 is hydraulically urged towards the backing roll 16.

The apparatus 10 also includes a base 32 which defines a cylinder 34. The cylinder 34 is selectively connected to a source 36 of hydraulic pressure. The cylinder 34 slidably receives therein the piston 22 such that when the cylinder 34 is connected to the source 36 of hydraulic pressure, the piston 22 is urged towards the backing roll 16.

The piston 22 also includes fastening means generally designated 38 which extends through the first and the second portions 26 and 28 for securing the portions 26 and 28 relative to each other.

The fasting means 38 includes at least one bolt 40 and the first and second portions 26 and 28 define respectively a first and a second aligned bore 42 and 44. The bores 42 and 44 threadably cooperate with the bolt 40 for fastening the first portion 26 to the second portion 28.

The resilient means 30 includes at least one rubber pad 46 which is disposed between the portions 26 and 28.

More specifically as shown in both FIGS. 1 and 2, the resilient means 30 includes a first and a second rubber pad 46 and 48 respectively. The first and the second pads define 46 and 48 respectively a first and a second hole 50 and 52. The holes 50 and 52 are aligned relative to each other and a locating pin 54 extends through the holes 50 and 52 for locating the pads 46 and 48 relative to each other. The locating pin 54 also aligns the pads 46 and 48 relative to the portions 26 and 28.

The piston 22 also includes a plate 56 disposed between the pads 46 and 48.

The present invention provides means for absorbing the shock exerted on a bearing blanket of an extended nip press so that the life of such bearing blanket is increased.

What is claimed is:

1. An extended nip press apparatus for pressing a web, said apparatus comprising:

an elongate press shoe which defines a concave surface;

a backing roll cooperating with said concave surface for defining therebetween an extended nip pressing section for pressing the web;

a looped bearing blanket slidably cooperating with said concave surface, said blanket being disposed between said shoe and said backing roll for supporting and guiding the web through said pressing section;

a piston pivotally connected to said press shoe, said piston being selectively urged towards said backing roll, the arrangement being such that when said piston is urged towards said backing roll, said piston urges said shoe and said blanket towards said backing roll so that the web disposed between said blanket and said backing roll is pressed;

said piston having a first and a second portion, said first portion being disposed between said second portion and said shoe; and resilient means including at least one rubber pad disposed between said portions effective for absorbing shock loads exerted on said blanket during operation of said apparatus so that wear of said blanket is reduced.

2. An extended nip press apparatus as set forth in claim 1 wherein:

said press shoe is a hydrodynamic shoe.

3. An extended nip press apparatus as set forth in claim 1 wherein:

said press shoe is a hydrostatic shoe.

4. An extended nip press apparatus as set forth in claim 1 wherein:

said looped bearing blanket is vented.

5. An extended nip press apparatus as set forth in claim 1 wherein:

said piston is hydraulically urged towards said backing roll.

6. An extended nip press apparatus as set forth in claim 1 further including:

a base which defines a cylinder, said cylinder being selectively connected to a source of hydraulic pressure, said cylinder slidably receiving therein said piston such that when said cylinder is connected to said source of hydraulic pressure, said piston is urged towards said backing roll.

7. An extended nip press apparatus as set forth in claim 1 wherein said piston further includes:

fastening means extending through said first and second portions for securing said first and second portions relative to each other.

8. An extended nip press apparatus as set forth in claim 7 wherein:

said fastening means includes at least one bolt;

said first and second portions defining respectively a first and a second aligned bore, said bores threadably cooperating with said bolt for fastening said first portion to said second portion.

9. An extended nip press apparatus as set forth in claim 1 wherein said at least one rubber pad includes:

a first and second rubber pad, said first and second pad defining respectively a first and a second hole, said holes being aligned relative to each other;

a locating pin extending through said holes for locating said pads relative to each other and for aligning said pads relative to said portions.

10. An extended nip press apparatus for pressing a web, said apparatus comprising:

an elongate press shoe which defines a concave surface;

a backing roll cooperating with said concave surface for defining therebetween an extended nip pressing section for pressing the web;

a looped bearing blanket slidably cooperating with said concave surface, said blanket being disposed between said shoe and said backing roll for supporting and guiding the web through said pressing section;

a piston pivotally connected to said press shoe, said piston being selectively urged towards said backing roll, the arrangement being such that when said piston is urged towards said backing roll, said piston urges said shoe and said blanket towards said backing roll so that the web disposed between said blanket and said backing roll is pressed;

said piston having a first and a second portion, said first portion being disposed between said second portion and said shoe;

resilient means disposed between said portions effective for absorbing shock loads exerted on said blanket during operation of said apparatus so that wear of said blanket is reduced; and said resilient means including:

a resilient pad disposed between said portions.

11. An extended nip press apparatus for pressing a web, said apparatus comprising:

an elongate press shoe which defines a concave surface;

a backing roll cooperating with said concave surface for defining therebetween an extended nip pressing section for pressing the web;

a looped bearing blanket slidably cooperating with said concave surface, said blanket being disposed between said shoe and said backing roll for supporting and guiding the web through said pressing section;

a piston pivotally connected to said press shoe, said piston being selectively urged towards said backing roll, the arrangement being such that when said piston is urged towards said backing roll, said piston urges said shoe and said blanket towards said backing roll so that the web disposed between said blanket and said backing roll is pressed;

said piston having a first and a second portion, said first portion being disposed between said second portion and said shoe;

resilient means disposed between said portions effective for absorbing shock loads exerted on said blanket during operation of said apparatus so that wear of said blanket is reduced;

said resilient means including:

a resilient pad disposed between said portions; and fastening means for aligning and fastening said first portion, said pad and said second portion relative to each other.

* * * * *